US005915642A

United States Patent [19]

Davis

[11] Patent Number: 5,915,642

[45] Date of Patent: Jun. 29, 1999

[54] DISPENSER HANDLE FOR ROLLS OF FLEXIBLE SHEETING MATERIAL

[75] Inventor: William B. Davis, Arlington, Tex.

[73] Assignee: Olympic General Corporation, Reno, Nev.

[21] Appl. No.: 08/843,746

[22] Filed: Apr. 21, 1997

[51] Int. Cl.[6] ..... B65H 16/06; B65H 23/06

[52] U.S. Cl. ..... 242/422.4; 242/571.5; 242/588.2

[58] Field of Search ..... 242/422.4, 442, 242/571.4, 571.5, 588.2, 557

[56] References Cited

U.S. PATENT DOCUMENTS

| | | | |
|---|---|---|---|
| D. 299,353 | 1/1989 | Goldstein . | |
| D. 299,654 | 1/1989 | Goldstein . | |
| D. 357,357 | 4/1995 | Feber . | |
| 3,312,410 | 4/1967 | Strothmann | 242/422.4 |
| 3,620,468 | 11/1971 | Amour | 242/571.5 |
| 4,102,513 | 7/1978 | Guard . | |
| 4,166,589 | 9/1979 | Hoover et al. . | |
| 4,179,081 | 12/1979 | Parry . | |
| 4,248,392 | 2/1981 | Parry . | |
| 4,372,500 | 2/1983 | Saraisky | 242/613.5 |
| 4,484,717 | 11/1984 | Goldstein . | |
| 4,575,020 | 3/1986 | Strout et al. . | |
| 4,582,273 | 4/1986 | Saraisky . | |
| 4,600,163 | 7/1986 | Hummel et al. . | |
| 4,659,031 | 4/1987 | Saraisky . | |
| 4,714,211 | 12/1987 | Hwang . | |
| 4,722,493 | 2/1988 | Parry et al. . | |
| 4,752,045 | 6/1988 | Goldstein . | |
| 4,784,348 | 11/1988 | McDonald . | |
| 4,817,762 | 4/1989 | Powell . | |
| 4,834,312 | 5/1989 | Riemenschneider | 242/588.2 |
| 5,094,395 | 3/1992 | Lambert . | |

*Primary Examiner*—John M. Jillions
*Attorney, Agent, or Firm*—Strasburger & Price, LLP

[57] ABSTRACT

The handle has an insert portion having a plurality of radially extending fins and a grip surface. The handle is inserted into a hollow core. The fins provide a fit that allows the core to rotate relative to the handle. The fins can deform when subjected to such rotation. The grip is positioned to allow the user to squeeze the handle against the core to slow or stop said rotation.

18 Claims, 3 Drawing Sheets

DISPENSER HANDLE FOR ROLLS OF FLEXIBLE SHEETING MATERIAL

FIELD OF THE INVENTION

This invention relates to a dispenser handle used to aid in the unrolling of materials rolled on a core, particularly stretch wrap. A pair of handles can be inserted into the ends of the hollow core and then selectively gripped against the core.

BACKGROUND OF THE INVENTION

Stretch wrap is used extensively in the shipping industry to secure multiple packages together on a single moving palette. The wrap is circled several times around the packages to prevent them from falling during transport. The wrap, when stretched, grips against the lower layers of wrap. Once the packages are moved, the stretch wrap can be cleanly cut away. Stretch wrap is provided on hollow cores, typically of heavy cardboard material. These rolls are difficult to manipulate with bare hands. Thus, a need exists for handles which allow for the easy handling of the cores and wrap. U.S. Pat. No. 4,582,273 to Sariasky discloses a pair of inserts used in dispensing a web of material from a core. The Sariasky design uses inserts that are inserted into both ends of the core. Then an elastic cord is attached between each insert though the core. This design requires the elastic cord, which can be difficult to attach between the handles, to hold the handles in the core. In another embodiment, a force fit cylinder is inserted into the core, and within that cylinder is a rotatable handpiece. This embodiment, however, is difficult and expensive to manufacture and does not adapt to variations in core diameter.

U.S. Pat. No. 4,752,045 to Goldstein discloses a reusable handle with a head that is force fit into the ends of a core. The user grips handle portions which extend outside of the core. This design tends to distance the user's hands from the web on the core. Often, it is desirable to use the thumb or other fingers to manipulate the stretch wrap while it is being dispensed.

A need exists for a handle design that is easy to manufacture and use. It should allow for either a force fit or a sliding fit within the ends of a core. Further, it should position a user's fingers close to the web being dispensed.

SUMMARY OF THE INVENTION

The present invention relates to a handle for use with a hollow core rolled with a web of material. The handle can be a single molded part which improves upon the more complicated and costly constructions in the prior art. The handle has an insert portion that fits into an end of the core, and within the insert portion is a grip surface. An outer flange limits the travel of the insert portion into the core. A plurality of fins extend outward from the insert portion to improve the fit of the handle against the core. The fins also compensate for minor variation in the inner diameter of the core.

In use, a pair of handles can be placed into opposite ends of the core. The user can then grip the core and its associated web and dispense it around a load. The fins allow the core to rotate relative to the handle. Indeed the fins are shaped to deform in response to such forces. However, the grip surface is placed such that the user can squeeze the handle against the core to increase the friction there between. As the friction increases, the speed of rotation slows or stops. Likewise, as the friction is increased between the handle and the core, the web being unrolled experiences a stretching force. This is particularly useful for stretch films whose gripping properties increase when stretched.

BRIEF DESCRIPTION OF THE DRAWINGS

The foreground aspects and other features of the present invention are explained in the following written description, taken in connection with the accompanying drawings, wherein.

DETAILED DESCRIPTION OF THE DRAWINGS

Figure 1:
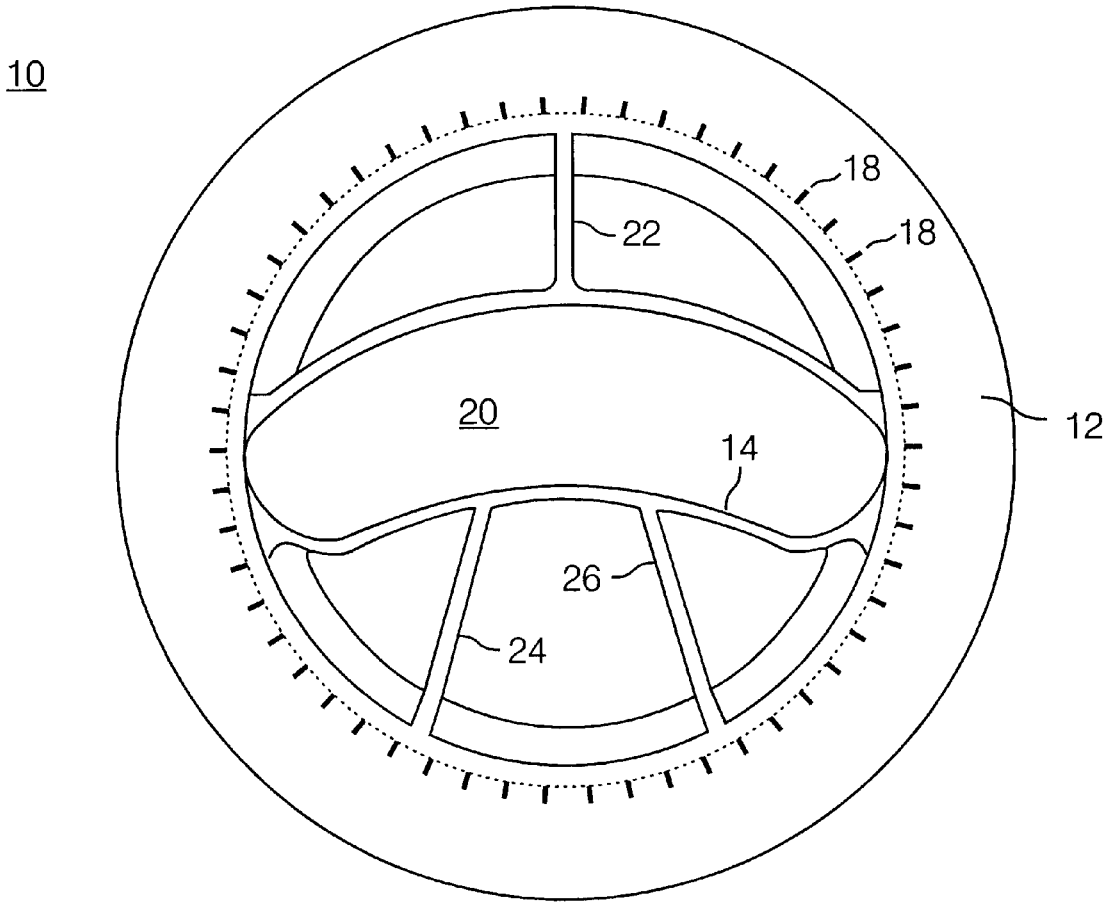
FIG. 1 is a top view of a handle embodying the present invention.
Figure 2:
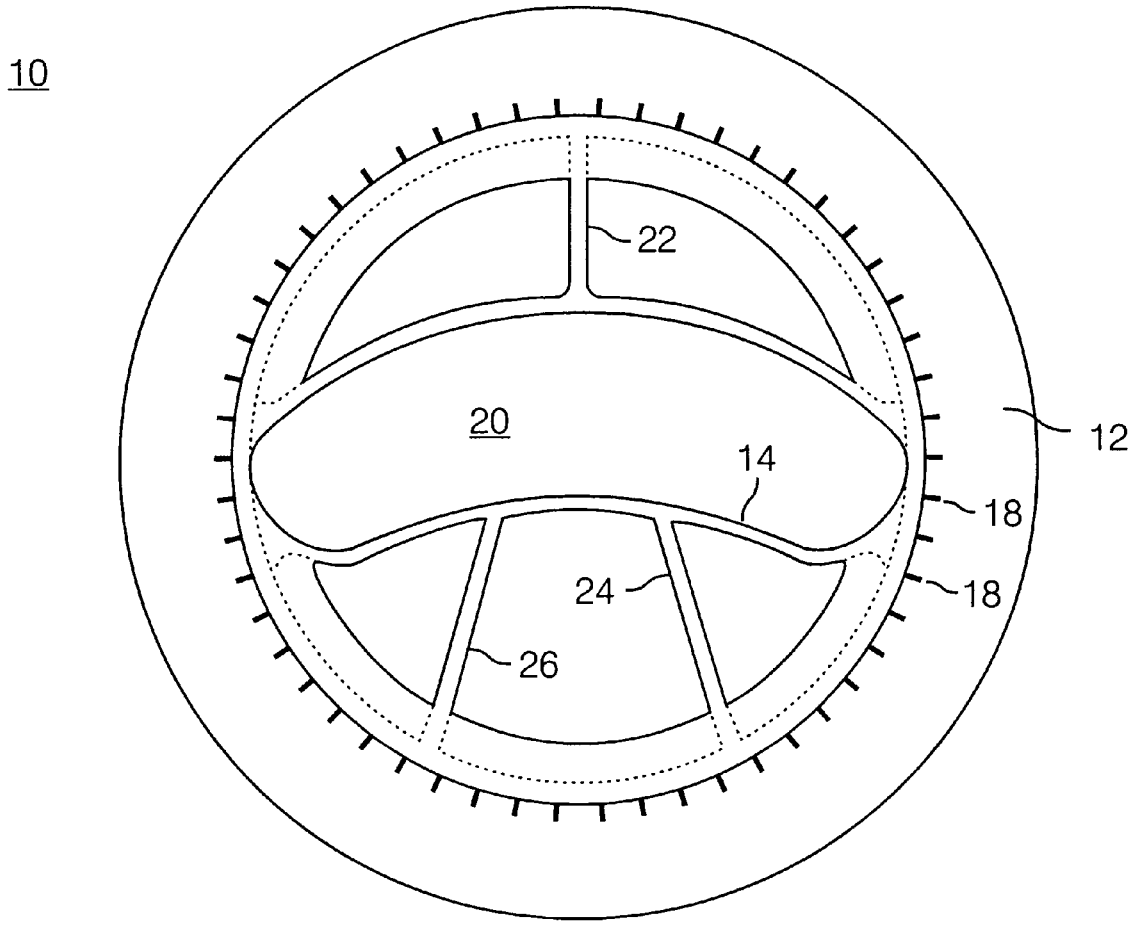
FIG. 2 is a bottom view of the embodiment shown in FIG. 1.
Figure 3:
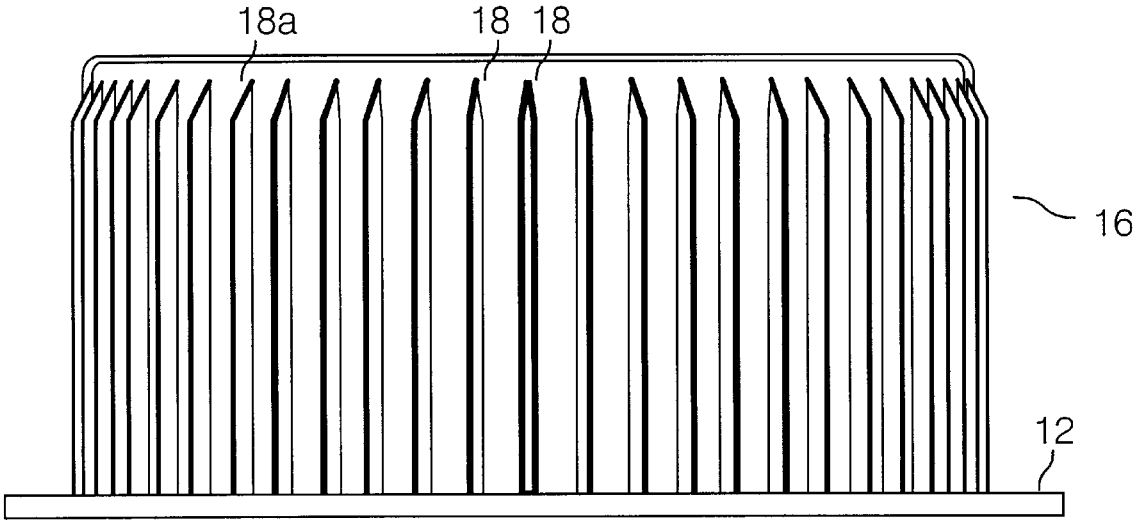
FIG. 3 is a front view of the embodiment shown in FIG. 1.

The present invention relates to a handle which overcomes many of the deficiencies found in prior art handles. The handle is specifically configured to engage a core on which a web of stretch film or other material is rolled. Referring to FIGS. 1, 2, and 3, a handle 10 is disclosed which embodies the present invention. The handle 10 has an outer flange 12 and a grip surface 14 for the user's hand. The handle further has an insert portion 16 from which a plurality of deformable fins 18 extend.

A pair of handles 10 can be placed into the ends of a hollow core. The outer flange 12 limits the travel of the handle 10 into the core. The insert portion 16 has an outer diameter that is slightly less than the inner diameter of the core. Cores, however, are not always consistently sized. In other words, a core can have a stated inner diameter of, for example, 3.00 inches. In actuality, a sample of cores could have inner diameters ranging from 2.92 inches to 3.08 inches, some having even greater variances. To improve the fit between the inset portion 16 and the inner diameter wall of the core, a plurality of fins 18 are provided. Each fin can have a taper on its proximal end 18*a*. In one embodiment, the fins are approximately 0.090" inches tall, and approximately 1.4 inches in length. The handles are typically made of Polyethylene.

The fins are flexible to rotational movement of the core. Thus, once inserted, the handle can be turned within the core. In use, typically, the wrap is started around a load and the handle held while the core rotates with the dispensing of the wrap. When the user wants to stretch the wrap, he need only apply his thumbs to the wrap to press the handle against the core.

The handle is designed for efficient manufacture and ease of use. The gripping surface 14 is attached to the inner diameter of the insert portion 16 by supports or stanchions 22, 24, 26. The grip surface 14 can have a slight curve to more naturally match the profile of the user's hand. The sizing of the opening 20 is also matched to provide adequate space for the user's finger's .

It will be appreciated that the detailed disclosure has been presented by way of example only and is not intended to be limiting. Various alterations, modifications and improvements will readily occur to those skilled in the art and may be practiced without departing from the spirit and scope of the invention. The invention is limited only as required by the following claims and equivalents thereto.

I claim:

1. A handle for use with a hollow core having an inner diameter comprising:

(a) an insert portion having an internal surface and an external surface;

(b) a grip surface integral within the insert portion to allow the handle to be grasped; and (c) a plurality of rigid load-bearing supports operatively disposed between the grip surface and the internal surface of the insert portion; and (d) a plurality of fins extending from the external surface of the insert portion to frictionally contact and allow manipulation of the inner diameter.

2. The handle of claim 1 further comprises (e) an annular outer flange having its inner periphery attached to the insert portion.

3. The handle of claim 1 wherein the insert portion has a generally cylindrical shape and has an outer diameter approximately equal to the inner diameter of the hollow core.

4. The handle of claim 1 wherein said plurality of fins are deformable.

5. The handle of claim 1 wherein said plurality of fins are deformable in response to a rotational force.

6. The handle of claim 1 wherein the fins are sized to permit controlled axial rotation of the hollow core around the insert member.

7. The handle of claim 1 wherein the fins form an outer insert diameter approximately equal to the inner diameter of the hollow core.

8. A handle for use with a hollow core, for holding a web of material, the core having an inner diameter, the handle comprising:

(a) an insert portion having an internal surface and an external surface (b) a plurality of fins extending radially from the external contact the inner diameter of the core;

(c) an outer flange attached to the external surface of the insert portion, the flange having an outer diameter greater than the inner diameter of the core to locate the handle in the core;

(d) a grip surface transversely integral within the internal surface of the insert portion; and (e) a plurality of rigid load-bearing supports connecting the grip surface and the internal surface of the insert portion.

9. The handle of claim 8 wherein said insert portion is substantially cylindrical.

10. The handle of claim 8 wherein the fins form an outer diameter approximately equal to the inner diameter of the hollow core.

11. The handle of claim 8 wherein said plurality of fins are deformable.

12. The handle of claim 8 wherein said plurality of fins are deformable in response to a rotational force applied by the core.

13. A method of dispensing a web of material from a hollow core having an inner diameter, the method comprising the steps of:

(a) providing a handle having an insert portion with a plurality of fins extending radially therefrom, the handle having an interior diameter, a grip surface and plurality of load-bearing supports connecting the grip surface and the insert portion;

(b) inserting the insert portion into the hollow core;

(c) gripping the grip surface; and (d) dispensing the web of material by controlling the rotation of inner diameter of the hollow core relative to the grip surface.

14. The method of claim 13 further comprises:

(d) pressing said handle against said core to increase the friction therebetween, thereby stretching said web.

15. A dispenser handle for use with a hollow core, the hollow core having an inner diameter, the handle comprising:

(a) an cylindrical insert portion having a first end, a second end, an inner surface and an outer surface, wherein the diameter of the outer surface is less than the inner diameter of the hollow core;

(b) a concave grip surface;

(c) a plurality of rigid stanchions, generally perpendicular to the grip surface, integrally disposed between the grip surface and the inner surface of the first end of the insert portion, providing support for the grip surface;

(d) an annular flange having its inner periphery attached to the outer diameter of the first end of the insert portion, adapted to abut one end of the core to locate the handle within the core, and (e) a plurality of fins attached radially to the outer diameter of the insert portion, such fins laterally positioned between the first end and the second end of the insert portion, such fins being flexible to allow controlled rotational movement of the hollow core by producing friction between the inner diameter of the hollow core and the fins.

16. A handle for holding rolled material wrapped around a hollow core comprising:

(a) a cylinder sized to fit within the hollow core;

(b) a flange attached to the cylinder at one end sized to abut the edge of the core when the cylinder is fitted within the core;

(c) a grip surface supported within the cylinder by radial stanchions;

(d) a plurality of radial fins longitudinally attached to the cylinder which are deformable to allow friction or contact with cores of different sizes.

17. The handle of claim 16 wherein the handle is made of plastic.

18. The handle of claim 16 wherein the cylinder is rigid.

* * * * *

UNITED STATES PATENT AND TRADEMARK OFFICE

CERTIFICATE OF CORRECTION

PATENT NO : 5,915,642

DATED : Jun. 29, 1999

INVENTOR(S) : Davis

It is certified that error appears in the above-identified patent and that said Letters Patent is hereby corrected as shown below:

Column 1, Line 61, Replace "Indeed the" with --Indeed, the--.

In the Claims:

Column 3, Line 32, After "external" insert --surface of the insert portion to--.

Signed and Sealed this

Second Day of November, 1999

*Attest:*

Q. TODD DICKINSON

*Attesting Officer*

*Acting Commissioner of Patents and Trademarks*